US011175097B2

(12) United States Patent
Streng

(10) Patent No.: US 11,175,097 B2
(45) Date of Patent: Nov. 16, 2021

(54) PACKING FOR HEAT AND/OR MASS TRANSFER

(71) Applicant: CTS Cooling Tower Solutions GmbH, Düsseldorf (DE)

(72) Inventor: Andreas Streng, Düsseldorf (DE)

(73) Assignee: CTS Cooling Tower Solutions GmbH, Düsseldorf (DE)

( * ) Notice: Subject to any disclaimer, the term of this patent is extended or adjusted under 35 U.S.C. 154(b) by 220 days.

(21) Appl. No.: 16/413,926

(22) Filed: May 16, 2019

(65) Prior Publication Data

US 2019/0353425 A1 Nov. 21, 2019

(30) Foreign Application Priority Data

May 18, 2018 (DE) ..... 20 2018 102 787.5

(51) Int. Cl.

| | |
|---|---|
| ***F28C 3/08*** | (2006.01) |
| ***F28C 1/02*** | (2006.01) |
| ***F28F 3/04*** | (2006.01) |
| ***F28F 25/02*** | (2006.01) |
| ***F28F 25/06*** | (2006.01) |
| ***F28F 25/10*** | (2006.01) |

(52) U.S. Cl.

CPC ..... *F28C 3/08* (2013.01); *F28C 1/02* (2013.01); *F28F 3/046* (2013.01); *F28F 25/02* (2013.01); *F28F 25/06* (2013.01); *F28F 25/10* (2013.01)

(58) Field of Classification Search

CPC ..... F28C 1/02; F28C 3/08; F28F 3/046; F28F 3/048; F28F 25/02; F28F 25/06; F28F 25/10

USPC ..... 261/110, 112.2, DIG. 72

See application file for complete search history.

(56) References Cited

U.S. PATENT DOCUMENTS

| | | | | |
|---|---|---|---|---|
| 1,847,216 A * | 3/1932 | Hubbard | ..... | F16J 15/22 277/538 |
| 3,618,778 A | 11/1971 | Benton et al. | | |
| 3,952,077 A | 4/1976 | Wigley | | |
| 4,296,050 A * | 10/1981 | Meier | ..... | B01D 59/02 165/166 |

(Continued)

FOREIGN PATENT DOCUMENTS

| | | |
|---|---|---|
| DE | 2722424 A1 | 11/1978 |
| DE | 2722556 A1 | 11/1978 |

(Continued)

*Primary Examiner* — Charles S Bushey

(74) *Attorney, Agent, or Firm* — Harness, Dickey & Pierce, P.L.C.

(57) ABSTRACT

A packing for heat and/or mass transfer between liquid and gaseous media in counter-flow, in particular for water cooling by air in cooling towers, includes a plurality of film elements contoured by corrugations. The corrugations provide flow passages and the film elements are successively arranged behind each other in the thickness direction forming points of contact. Adjacent film elements are connected to one another at their points of contact and mutually facing large surfaces of adjacent film elements have a fine contouring. The fine contouring includes a ribbing with rib webs and rib grooves running transversely to the flow passages. A rib groove is disposed between two adjacent rib webs. The transitions between successive rib webs and rib grooves are designed such that they are substantially free of radii.

10 Claims, 8 Drawing Sheets

(56) References Cited

U.S. PATENT DOCUMENTS

| | | | | | |
|---|---|---|---|---|---|
| 4,675,103 | A * | 6/1987 | Nadudvari | C02F 3/10 | 210/150 |
| 4,801,410 | A * | 1/1989 | Kinney, Jr. | F28F 25/087 | 261/112.2 |
| 4,929,399 | A * | 5/1990 | Lockett | B01J 19/32 | 261/112.2 |
| 5,124,087 | A * | 6/1992 | Bradley | B01J 19/32 | 261/112.2 |
| 5,167,879 | A * | 12/1992 | Streng | B01J 19/32 | 261/112.2 |
| 5,454,988 | A * | 10/1995 | Maeda | F28F 25/087 | 261/112.2 |
| 5,616,289 | A * | 4/1997 | Maeda | B01F 3/04475 | 261/112.2 |
| 6,578,829 | B2 | 6/2003 | Ender et al. | | |
| 8,622,115 | B2 * | 1/2014 | Seebald | F28D 19/044 | 165/8 |
| 2012/0049392 | A1 * | 3/2012 | Trompiz | B01J 19/32 | 261/112.2 |
| 2017/0198992 | A1 * | 7/2017 | Shin | F28C 1/02 | |

FOREIGN PATENT DOCUMENTS

| | | | |
|---|---|---|---|
| DE | 3918483 | A1 | 12/1990 |
| DE | 4122369 | C1 | 10/1992 |
| EP | 0056911 | A2 | 8/1982 |
| EP | 1078684 | A1 | 2/2001 |
| WO | 2009-149954 | A1 | 12/2009 |

* cited by examiner

PACKING FOR HEAT AND/OR MASS TRANSFER

CROSS-REFERENCE TO RELATED APPLICATIONS

This application claims the benefit and priority of DE 20 2018 102 787.5, filed May 18, 2018. The entire disclosure of the above application is incorporated herein by reference.

FIELD

The invention relates to a packing for heat and/or mass transfer between liquid and gaseous media in counter-flow, in particular for water-cooling by air in cooling towers, comprising a plurality of film elements contoured by corrugations, wherein the corrugations provide flow passages and wherein the film elements are arranged one behind the other in the thickness direction forming points of contact, wherein adjacent film elements are connected to each other at their points of contact and wherein mutually facing large surfaces of adjacent film elements have a fine contouring.

BACKGROUND

Cooling towers for water-cooling in general and cooling installations for cooling towers—also known as packings—in particular are well known in prior art.

Cooling towers particularly serve for cooling liquid media, i.e. fluids such as water, by means of ambient air. For this purpose, known cooling towers have a fluid cooling device, which in turn includes cooling installations, i.e. so-called packings, and a fluid distribution device. The fluid to be cooled is sprayed above the packages by means of the fluid distribution device and trickles downwards along the packages following gravity. Air flows through the packings preferably in counter-flow to the fluid to be cooled, for the purpose of cooling. As a result of the contact between the fluid to be cooled and the air inside the packings, cooling of the fluid to be cooled takes place as intended.

In order to guide the ambient air serving as cooling air through the cooling tower in the manner described above, a fan is provided which promotes the air flow through the cooling tower and in particular through the cooling installations. This fan is typically arranged in the height direction of the cooling tower above the fluid cooling device. During normal operation, the fan draws in ambient air from below the fluid cooling device, which flows as cooling air through the fluid cooling device arranged below the fan in the height direction of the cooling tower. The ambient air sucked in by the fan is discharged to the atmosphere as heated ambient air after flowing upwards through the packings.

A cooling tower of the type described above, for example, is known from WO 2009/149954 A1.

In order to achieve the most effective heat exchange possible between the media involved, a packing design is known in prior art in which a plurality of film or plate elements contoured by corrugations are provided. These film elements are arranged one behind the other in the thickness direction, with the corrugations providing flow passages. At their points of contact, adjacent film elements are connected to each other. Furthermore, the mutually facing large surfaces of adjacent film elements have a fine contouring. This fine contouring serves to further optimize heat exchange.

A generic package is known from DE 41 22 369 C1.

Furthermore, DE 27 22 424 A1 discloses an installation element for mass and heat exchange columns. The installation element consists of mutually contacting folded lamellae of film-like material arranged parallel to the column axis. The folds of the lamellae are at an angle to the column axis. The folding walls of the lamellae are additionally finely serrated and the lamellae have a plurality of holes distributed over their surface. The serration results from a roughening of the lamella surface by grooves or embossing of patterns.

From DE 27 22 556 A1 a filling body made of film-like material with trickle surfaces for columns for mass and heat exchange is known. It is intended that the trickle surfaces alternately have smooth and finely serrated sections, with the individual sections extending over a height of at least 5 mm.

DE 39 18 483 A1 concerns a filling body for heat and mass exchange in counter-flow. The filling body comprises a plurality of vertically and obliquely placed superimposed and interconnected corrugated or folded films or plates which are so formed and/or superimposed and interconnected that the corrugations or folds of adjacent films or sheets cross. The corrugations or folds of adjacent films or plates only cross in the upper part of the filler, while they run parallel to each other in the lower part.

U.S. Pat. No. 6,578,829 B2 relates to a section of a packing comprising a plurality of vertically aligned diagonally cruciformly corrugated packing sheets. The packing sheets define a section height, the section having a base area, a volume area, and an upper area. The base area has a first specific geometry that is different from a geometry of the volume area. The upper part also has a specific second geometry that is different from the geometry of the volume area as well as from the geometry of the base area.

EP 0 056 911 B1 concerns a filling part for filling purposes in a water cooling tower which, in its basic state, comprises vertical sheets of moldable material everywhere with a generally zigzag downfacing spiral-shaped pattern. Each sheet has a pair of opposite sides intended to be wetted by heated water flowing downwards over the same. The moldable material is equipped with horizontal ribs forming angular recesses. It is also provided that the filling part includes water-cooling pockets at the sinusoidal bend between each rib and that the pockets of the recesses are arranged at an angle with respect to the horizontal.

EP 1 078 684 A1 discloses an organized packing for separation columns, which has contoured layers and passages arranged therein. The passages are oriented obliquely to a main flow direction. The layers are formed into a section shape from film-like and fabric-shaped strips of material.

Although the design of a packing for heat and mass transfer between liquid and gaseous media known from DE 41 22 369 C1 has proven its worth in everyday use, there is still room for improvement. In particular, the aim is to further increase efficiency. And this preferably without significant additional production costs. It is therefore the object of the invention to further develop a generic packing in such a way that an improved heat and mass exchange between the media involved is achieved under intended operation conditions.

SUMMARY

This section provides a general summary of the disclosure, and is not a comprehensive disclosure of its full scope or all of its features.

In order to achieve this object, the invention proposes a packing of the aforementioned type which is characterized in that the fine contouring comprises a ribbing with rib webs and rib grooves, wherein a rib groove is arranged between two rib webs, wherein the transitions between successive rib webs and rib grooves are substantially free of radii.

According to the invention, the fine contouring formed on the large surfaces of the film elements is designed as ribbing. The ribbing runs transversely to the flow passages of the film elements. For example, a ribbing can be provided which runs parallel to the marginal edges of the film elements on the input or output side.

According to the invention, the ribbing has rib webs on the one hand and rib grooves on the other hand, with a rib groove arranged between two adjacent rib webs. This results in an alternating arrangement of rib webs and rib grooves in the longitudinal direction of the film elements.

The transitions between rib webs and rib grooves succeeding each other in the longitudinal direction of the film elements or in the transverse direction of the ribbing are substantially free of radii. The term "substantially" here means a design without transition radii, in particular where technically possible. According to the invention, it is important to avoid transition radii between the successive rib webs and rib grooves, so that the result is a "sharp-edged" design.

Studies by the applicant have shown that the radii-free design of the transitions between successive rib webs and rib grooves results in improved efficiency. This improved efficiency can be explained by the fact that during operation a fluid film is formed on the vertically aligned large surfaces of the film elements, which flows along that large surfaces following gravity. Due to the sharp-edged design of the rib webs and grooves, the ribbing of the fine contouring running transversely thereto ensures that turbulent flow conditions occur in each of the areas of the transitions between successive rib webs and rib grooves. These turbulent flow conditions ensure better heat and mass exchange between the fluid to be cooled, e.g. water, and the gaseous medium, e.g. the ambient air, which is guided through the packing in counter-flow. As a result, a further optimized operation of the packing according to the invention can be achieved.

According to prior art, the deliberate design of transition radii between rib webs and rib grooves is provided in order to be able to better remove the film elements, which are usually made of a plastic material, from a molding tool. However, it was not recognized that transition radii minimize the barrier effect of fine contouring, which has a positive effect on the efficiency of a packing, and thus promote the creation of a laminar flow. The sharp edges of both the rib webs and the rib grooves as now provided by the invention in contrast to prior art, provide a remedy here, since turbulent flow conditions are produced as a result of this design during operation, which results in improved mixing of the two media involved and hence in increased heat exchange. A disadvantage of the sharp-edged design of the transitions between the rib webs and the rib grooves as provided according to the invention, however, is that the pressure loss on the gas side, i.e. the air side, increases. Thus more energy is required by the fan to convey the cooling air flowing through the packing. However, this disadvantage is deliberately tolerated here because in sum the design according to the invention achieves a higher overall efficiency. This has significant advantages for the operation of corresponding plants in the most diverse branches of industry in the form of smaller and thus more cost-effective plants as well as lower overall operating costs.

According to a further feature of the invention it is provided that the corrugations provide flow passages which are inclined in the longitudinal direction of the film elements, preferably zigzag flow passages, the film elements being arranged alternately in the thickness direction so that the flow passages of adjacent film elements extend with opposite inclinations and cross while forming points of contact.

According to this embodiment of the invention, the flow passages are not aligned in a straight line in the longitudinal direction of the film elements, but inclined to it. A zigzag design is preferred. The inclination of the flow passages to the vertical has the positive effect that the flow path is extended with respect to the height extension of the packing according to the invention, which results in an improved heat exchange.

The reference value for the design of the transition radii may be the width of a rib web, in particular the width of the plateau terminating a rib web on the upper side. It is therefore proposed according to another feature of the invention that the transition radii are designed <20%, preferably <10%, even more preferably <5% of the rib web plateau width of the corresponding rib web. If, for example, the rib web plateau width measures 5 mm, a transition radius of preferably <0.5 mm and even more preferably <0.25 mm is obtained.

The smaller the transition radii are selected, the slower the demolding speed can be when demolding a film element from the molding tool during production. This disadvantage is consciously tolerated with the design according to the invention, since the later efficiency of the film element formed in this way is significantly improved compared to prior art. For manufacturing reasons it will not be possible to achieve a transition radius of zero. "Substantially" in terms of the invention therefore means that the transition radii must be as small as possible in connection with applying conventional manufacturing processes. This is because the more "sharp-edged" the ribbing design is, the more significantly the effect of a turbulent flow occurs during normal operation.

According to another feature of the invention it is provided that a rib groove is intended to have a groove depth of 2.0 mm to 3.0 mm, preferably 2.2 mm to 2.8 mm, more preferably 2.4 mm to 2.6 mm, most preferably 2.5 mm. As studies by the applicant have shown, a groove depth within the specified range achieves optimum efficiency. If the groove depth is significantly smaller or significantly larger, flow effects will occur at the rib webs and/or rib grooves during normal operation that prevent effective heat and/or mass exchange between the media involved. In addition, in this context, if the groove depth is too large, the pressure loss within the air sucked through the packing by the fan increases significantly, which has to be compensated by a higher fan power, which in turn has a negative effect on the overall energy aspect. In this respect, a synergetic effect is achieved with a groove depth in the size range in accordance with the invention to the effect that, on the one hand, a turbulent flow required for improved heat and/or mass transfer is achieved and, on the other hand, the pressure loss resulting from the flow of ambient air through the packing is minimized.

According to another feature of the invention it is provided that a rib groove has a groove width of 4.0 mm to 6.0 mm, preferably 5.0 mm. A ratio of groove depth to groove width of 0.6 to 0.4, preferably 0.5, is particularly preferred. For example, if the groove depth is 2.5 mm, the groove width should be 5 mm.

For the aforementioned reasons, it is therefore preferable to provide the large surfaces of the film elements facing each other as extensively as possible with a fine contouring in sense of the invention. It is preferable to leave out only a few regions of the large surfaces of the film elements, such as the input-side and output-side end regions of the film elements.

In order to further reduce the pressure loss occurring on the air side, a further feature of the invention provides that the inclination of the flow passages to the vertical in the final mounted state is <22°, preferably between 19° and 15°, and even more preferably 17°. The inclination of the flow passages to the vertical has the positive effect of extending the overall flow path to be traveled, which fact also improves heat and/or mass transfer. The greater the inclination to the vertical, the greater the pressure loss occurring in the air flow during operation. In the way already described, this inevitably leads to a necessary increase in fan power, which has a negative effect on the overall energy balance. In order to minimize power, the basic aim is to allow the flow passages to run parallel in the longitudinal direction, which in turn leads to a deterioration in heat and/or mass exchange due to the shortened flow path. The fine contouring according to the invention makes it possible to bring actually conflicting interests together in such a way that an optimized balance is achieved, because this fine contouring enables an increased heat and/or mass exchange, so that it is possible for minimizing the pressure loss in the cooling air to set the inclination angle of the flow passages to the vertical smaller than usual, namely smaller than 20°. This was not to be expected in view of known prior art.

The groove depth in the sense of the invention is preferably the groove depth averaged over the groove width. Alternatively, the groove depth in relation to the groove width in the middle of the groove can also serve as a reference value.

According to another feature of the invention it is provided that the end regions of a film element opposite each other in the longitudinal direction are free of fine contouring.

In particular, it is preferred that the edge or end region of the packing, which is intended to be on the liquid inlet side when used as intended, be free of fine contouring. This is to ensure an optimized distribution of the liquid discharged by the liquid distribution device arranged above the packing to the individual flow passages of the packing. It is achieved in this way that all flow passages are subject to a uniform amount of liquid. Such an even distribution of liquid can be supported by the provision of corresponding nozzles of the liquid distribution device.

According to another feature of the invention it is provided that in the end regions of the film elements that are free of fine contouring, channels running obliquely to the longitudinal extension of the film elements are formed. These channels are preferably formed on the liquid inlet side and liquid outlet side of the packing in the film elements. In particular, they serve to improve the flow of the liquid out of the packing after it has flowed through it and to allow it to drip off. As a result of this measure, a reduced pressure loss on the gas or air side is also achieved. In this context, it is particularly preferred that two channels are provided for each flow passage, which are aligned to each other in a V-shape. The liquid film thus formed on the inner side walls of the flow passages during intended use can thus flow off better on the outlet side without accumulating liquid waves forming which would oppose the air flowing in the opposite direction with increased resistance, as is the case with prior art. This improved outflow or drip-off effect can also be supported by the fact that the two channels open into a common outlet that is aligned in the direction of the longitudinal extension of the film elements. This results in A-like structures on the outlet side of the flow channels, which results in an improved outflow of the liquid admitted to the packing.

According to another feature of the invention it is provided that the mutually facing flow passages of adjacent film elements form a film or plate pair passage with a hexagonal passage cross section on the input and output sides respectively.

The mutually facing flow passages of adjacent film elements constitute a film pair passage in the final assembled state of the film elements. In this respect, each film element provides a flow passage open on one side. In the final mounted state of the packing, these flow passages of the individual film elements cooperate forming a respective film pair passage. On the input and output sides, said film pair passages preferably have a polygonal, preferably a hexagonal cross section. The pitch, i.e. the height of each flow passage in the molding depth of the film element, is preferably 12 mm, 20 mm or 30 mm. This results in a passage width of 24 mm, 40 mm or 60 mm on the input or output side of the packing for a film pair passage, based on the film spacing or film pitch. Since adjacent film elements lie against each other at their points of contact and are preferably connected to each other there, wide passages of 24 mm, 40 mm or 60 mm are initially created on the input side or output side, which passages then meet the opposite passages of the adjacent secondary film due to the inclined arrangement, so that a passage width of 12 mm, 20 mm or 30 mm is achieved at the narrowest points of the passages. This value substantially determines the amount of material required and is decisive for the behavior of the packing according to the invention when used as intended. The smaller the distance, the tighter is the packing. However, the higher the power density of the packing as a result of this measure, the more it becomes contaminated in long-term operation, i.e. the so-called fouling behavior deteriorates. In this respect, careful selection and setting of these parameters is necessary, taking into account the operating conditions prevailing at the operating site.

The corrugations of the film elements have a polygonal, preferably hexagonal passage cross section on the input or output side whose edge lengths are preferably different. In this context, it is preferred that the corrugations of the film elements comprise a first strip portion extending in the longitudinal direction of said film elements and second and third longitudinal strips disposed thereon along their respective longitudinal edges, said second and third strip portions being inclined to said first strip portion. The second and third strip portions are of equal width and each has a width that exceeds the width of the first strip portion. Accordingly, the smaller the short edge length, i.e. the smaller the width of the first strip portion, the more the preferably hexagonal passage cross-section of a film pair passage approaches a quadrangular design. Studies by the applicant have shown that the preferred ratio of short to long hexagonal side length, i.e. the width ratio of the first strip portion to the second strip portion or the third strip portion, is between 0.3 and 0.4, preferably 0.35. In this way, a thickness of the liquid film forming on the surfaces of the flow passages is as uniform as possible and thus favorable for an optimized heat and mass transfer.

The width of the first strip portion or the short edge length of the passage cross section is dependent on the pitch, but is at least 5 mm. With a 20 mm pitch, the edge length is between 8 mm and 12 mm, preferably 10 mm. If the short edge length, i.e. the width of the first strip portion, is clearly below these value parameters, a comparatively narrow liquid passage is created, which can lead to liquid accumulation in this passage during operation and which reduces the overall effectiveness of the packing according to the invention.

Further studies by the applicant have shown that the measures in accordance with the invention can increase the efficiency of the packing by up to 8% or 10% compared with the previously known designs. Furthermore, it has been shown that considerable savings can be achieved in terms of installation height and resulting installation volume compared to known designs with the packing in accordance with the invention. Depending on the design of the cooling tower, these amount to between 20% and 30%, which leads to significant cost savings when constructing cooling towers or re-equipping them with packings in accordance with the invention.

DRAWINGS

Further features and advantages of the invention will be become apparent from the following detailed description taken in conjunction with the drawings wherein it is shown by:

FIG. 1 shows a cooling tower 1 as known, for example, from prior art according to WO 2009/149954 A1.

DETAILED DESCRIPTION

Figure 1:
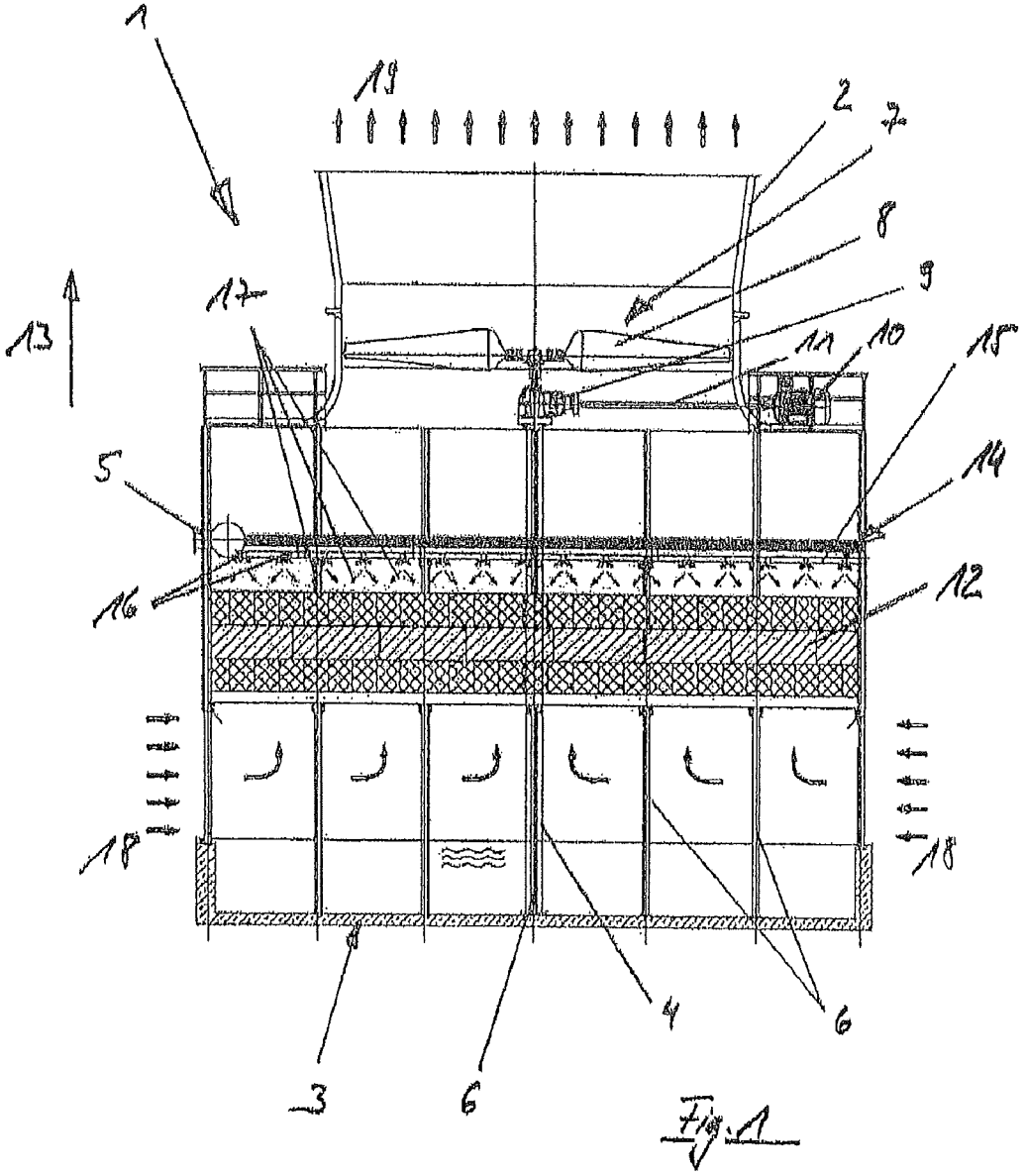
Fig. 1 PRIOR ART
FIG. 1 is a schematic side view of a cooling tower according to prior art.

The cooling tower 1 is equipped with a liquid cooling device, which in turn has a liquid distribution device 14 on the one hand and cooling installations 12 on the other. The liquid distribution device 14 is arranged in height direction 13 above the cooling installations 12.

The liquid distribution device 14 has a plurality of distribution pipes 15 which are connected to a common feed pipe 5 on the side of the liquid. The distribution pipes 15 of the liquid distribution device 14 are equipped with nozzles 16 on the side of the cooling installations, by which nozzles the liquid supplied to the liquid distribution device 14, for example water, is distributed in the direction of the arrows 17 to the cooling installations 12 during operation.

In the intended operating mode, ambient air is guided as cooling medium from bottom to top through cooling tower 1 by means of a suction fan wheel 8 in accordance with arrows 18 and 19 with reference to the drawing plane according to FIG. 1. In the course of passing the ambient air through the cooling tower 1, the air passes the cooling installations 12, which are three-layered in the embodiment shown.

The liquid to be cooled by means of the cooling tower 1, for example water, is introduced into the liquid distribution device 14 via feed pipe 5. Here it reaches the distribution pipes 15, which are equipped with preferably tangentially mounted full-cone nozzles 16 for the purpose of liquid discharge. The distance between the outlet openings of the nozzles 16 and the upper edge of the cooling installations 12 determines the spraying height, which for example is 600 mm.

The water distributed evenly over the cooling installations 12 by means of the liquid distribution device 14 trickles through the cooling installations 12 in counter-flow to the cooling air conveyed from bottom to top.

The water cooled after trickling through the cooling installations 12 drips off from the cooling installations 12 and is collected in the water collection tank 3.

As can also be seen from the illustration according to FIG. 1, support struts 6 are provided to support the liquid cooling device relative to the water collection tank 3, which support the liquid cooling device, i.e. the liquid distribution device 14, as well as the cooling installations 12.

In height direction 13 above the liquid cooling device, a cooling tower jacket 2 is provided which accommodates the fan wheel 8. The fan wheel 8 is part of an axial fan 7, which also has a gear arrangement 9, a motor 10 and a shaft 11 coupling the motor 10 with the gear arrangement 9. The gear arrangement 9 together with the fan wheel 8 is supported by a column 4 that protrudes through the liquid cooling device.

The cooling installations 12 provided in height direction 13 below the liquid distribution device 14 contain packings of the type according to the invention, the structure of which can be seen in the further FIGS. 2 to 13.

The packing 20 in accordance with the invention (cf. FIG. 8 and FIG. 9) for heat and/or mass transfer between liquid and gaseous media in counter-flow, in particular for water-cooling by air in a cooling tower 1 according to FIG. 1, has a plurality of film elements 21 contoured by corrugations 22. Such a film element 21 according to a first embodiment is shown in a side view in FIG. 2.

Figure 3:
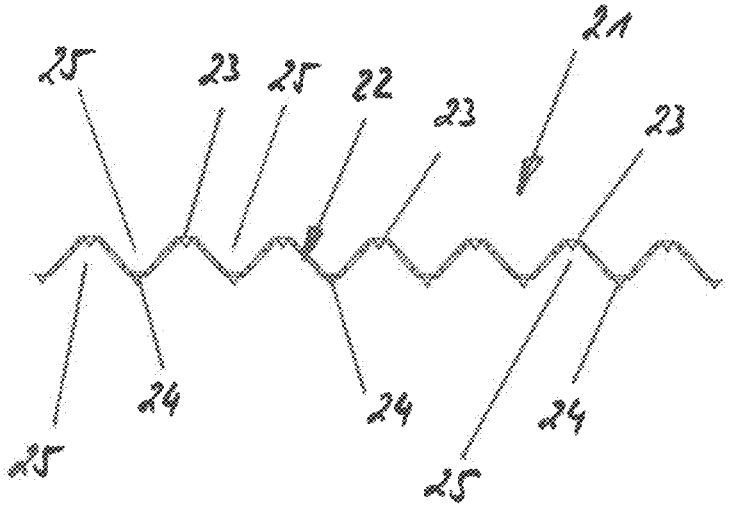
FIG. 3 is a sectional view of the film element of FIG. 2 taken along section line B-B of FIG. 2.

The corrugations 22 of the film element 21 provide flow passages 25, as can be seen in particular from the sectional view according to FIG. 3. As can be seen from this illustration, the corrugation of film element 21 is composed of successive wave crests 23 and wave troughs 24, with a wave trough 24 arranged between two wave crests and a wave crest 23 between two wave troughs 24. With reference to the drawing plane according to FIG. 3, the corrugation 22 provides flow passages 25 on both the top and bottom sides of the film element 21.

Figure 2:
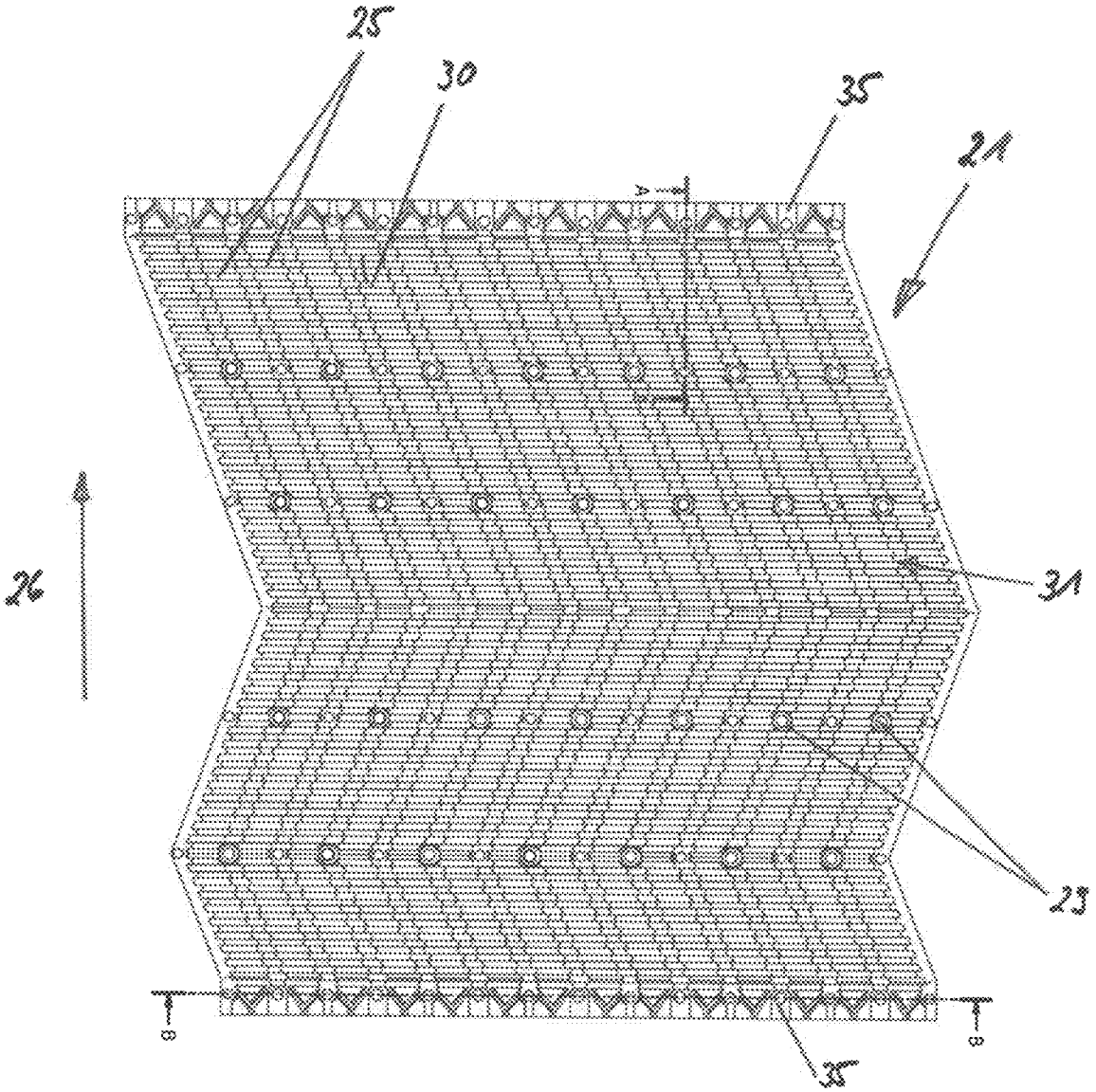
FIG. 2 is a schematic side view of a film element of a packing according to a first embodiment of the invention.

As the view according to FIG. 2 shows, the flow passages 25 run in longitudinal direction 26 of the film element 21, i.e. in the intended installation case in height direction from top to bottom or from bottom to top.

The preferred embodiment of the invention according to FIGS. 2 to 7 shows a film element 21 according to which the corrugations 22 provide flow passages 25 which are inclined in the longitudinal direction 26, i.e. flow passages 25 which run zigzag-shaped. This is apparent in particular from the illustration according to FIG. 2. The film elements 21 intended to form a packing 20 in accordance with the invention are arranged alternately in the thickness direction 40—also called depth direction—as shown in the illustration according to FIG. 8, so that the flow passages 25 of adjacent film elements 21 extend with opposite inclinations and cross while forming points of contact 29. At the points of contact 29, adjacent film elements 21 are connected to each other, for example by gluing and/or welding.

The film elements 21 each have a fine contouring 31 on their large surfaces 30. This fine contouring 31, also called micro-corrugation or microstructure, has a ribbing 32 running transversely to the flow passages 29 with rib webs 33 and rib grooves 34, as this is apparent in particular from the side view according to FIG. 4 and the sectional view according to FIG. 5.

Figure 5:
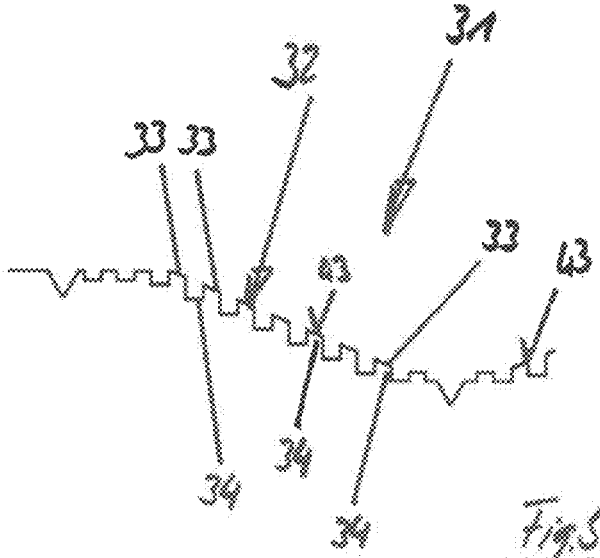
FIG. 5 is a sectional view of the film element of FIG. 2 taken along section line A-A of FIG. 2.
Figure 6:
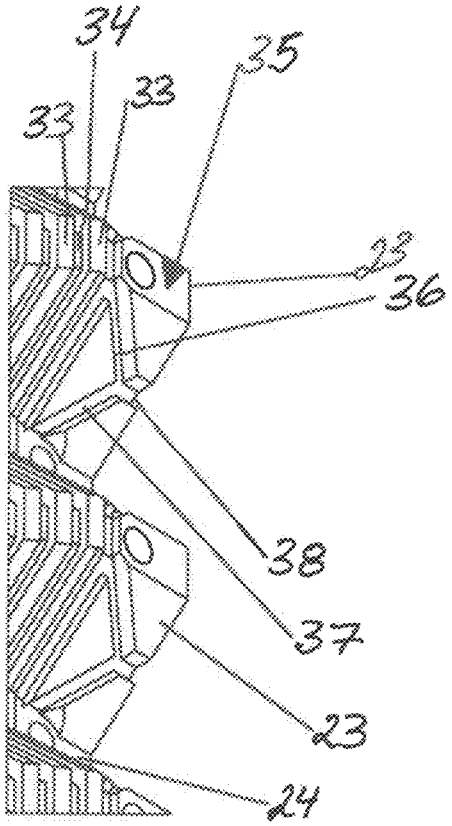
FIG. 6 is a schematic perspective view of the output side end region of the film element of FIG. 2 in extracts.
Figure 7:
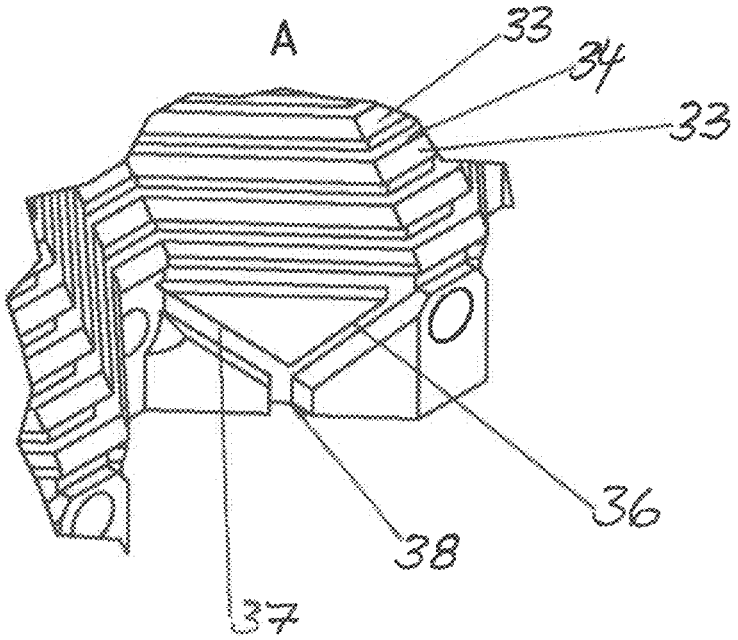
FIG. 7 is a schematic perspective view of the output side end region of FIG. 6.

As can be seen in particular from the sectional view according to FIG. 5, a rib groove 34 is arranged between two adjacent rib webs 33 of the ribbing 32. According to the invention, the transitions between successive rib webs 33 and rib grooves 34 are substantially free of radii. In this sense, there is a sharp-edged transition between the rib webs 33 and the rib grooves 34.

In terms of the invention, a "substantially" radii-free design means a design without transition radii if possible from a manufacturing point of view. It is therefore important to avoid transition radii between the successive rib webs 33 and rib grooves 34, so that the result is a "sharp-edged" design. "Substantially" in terms of the invention means in particular that the transition radii should be as small as possible when applying conventional manufacturing processes. The more "sharp-edged" the rib design is, the more clearly the desirable effect of a turbulent flow in the intended operating conditions is achieved.

Figure 4:
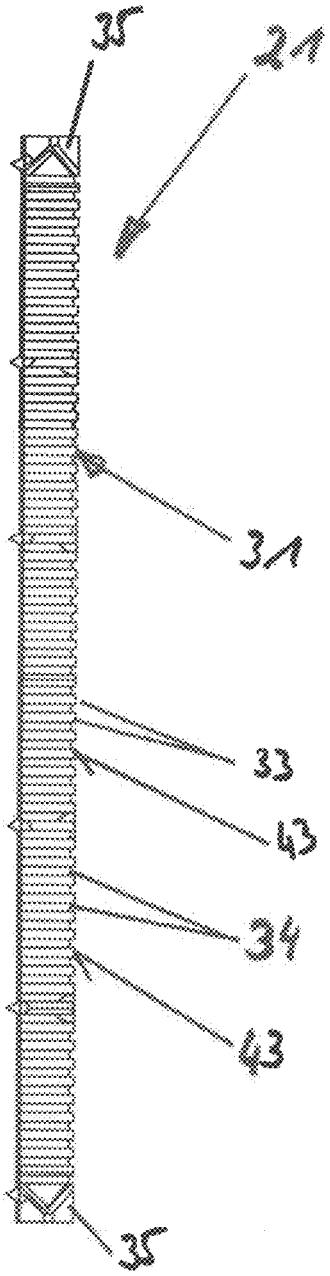
FIG. 4 is a front-side view of the film element of FIG. 2.

As shown by FIGS. 2 and 4, for example, the end regions 35 of the film element 21 opposite each other in the longitudinal direction 26 are free of fine contouring. In particular, this ensures an improved exit of water from the packing 20 in accordance with the invention. This positive effect is supported by the fact that in the end regions 35 of the film elements 21 without fine contouring, channels 36 and 37 running obliquely to the longitudinal extension 26 of the film elements 21 are formed, as can be seen from a combined view of FIGS. 6 and 7. In this case, a film element 21 has two channels 36 and 37 for each flow passage 25, which are aligned to each other in a V-shape. These two channels 36 and 37 flow into a common outlet 38, which is aligned in the direction of the longitudinal extension 26 of the film elements 21.

Figure 8:
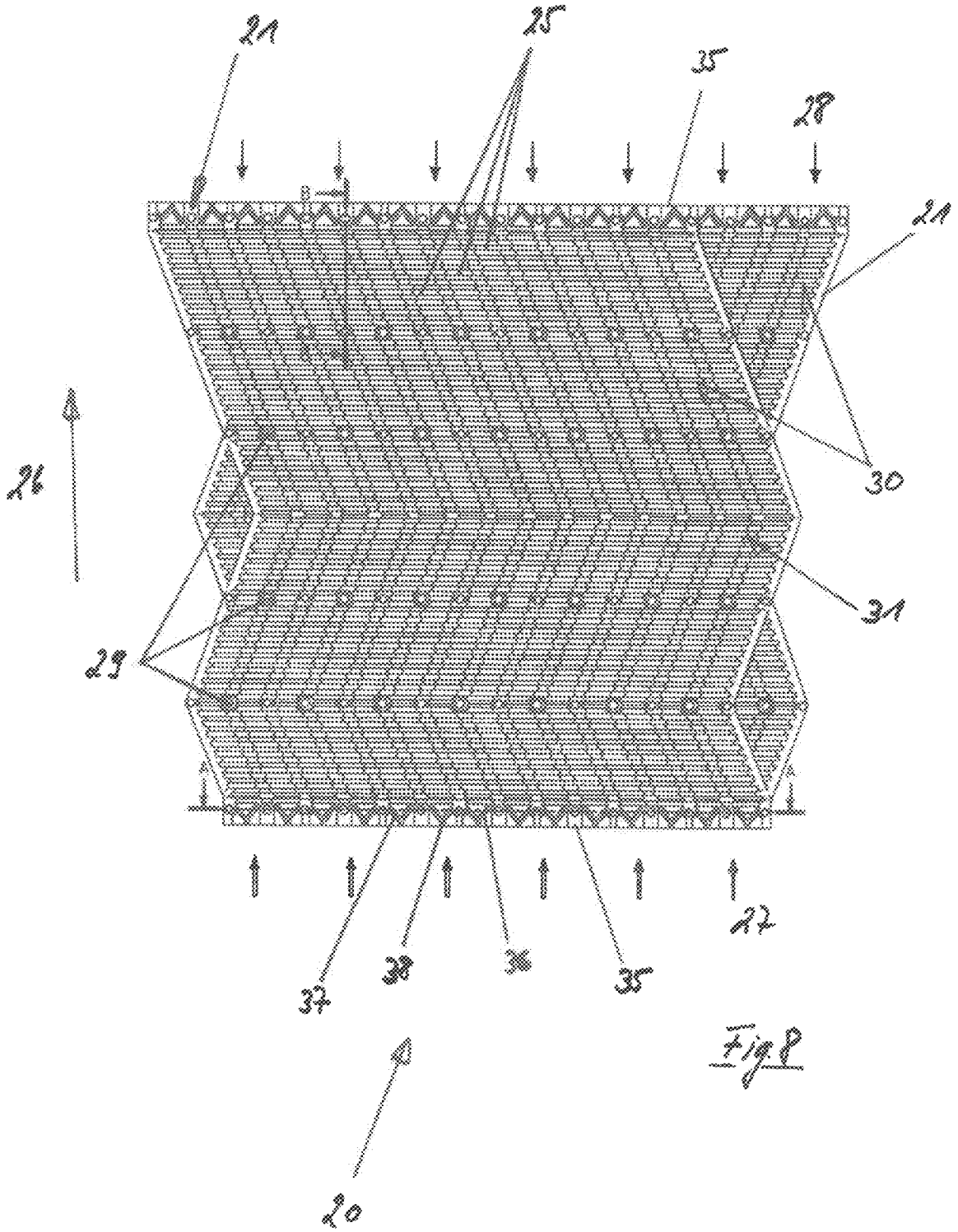
FIG. 8 is a schematic view of a packing in accordance with the invention.
Figure 10:
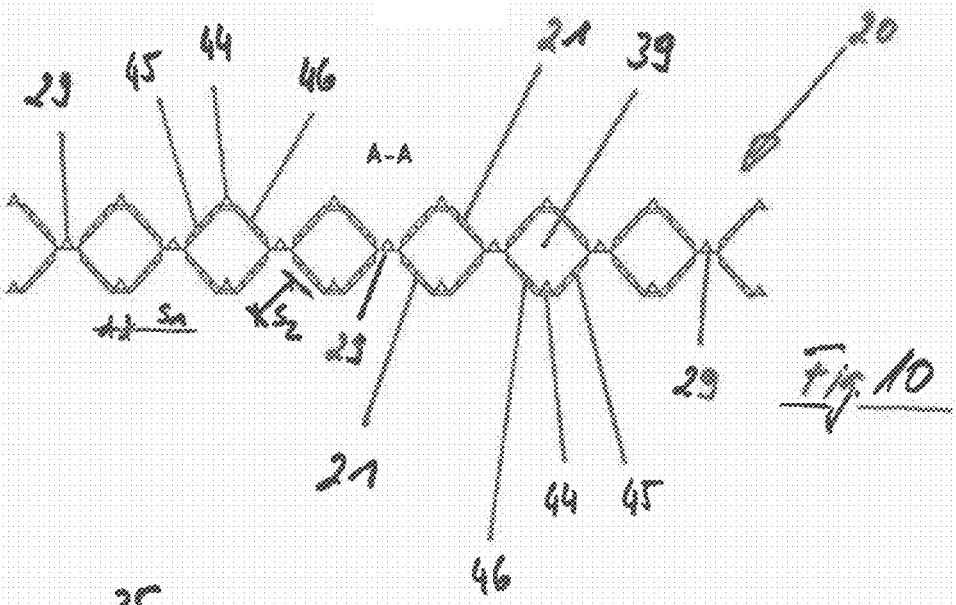
FIG. 10 is a schematic sectional view of the packing of FIG. 8 according to section line A-A of FIG. 8.
Figure 9:
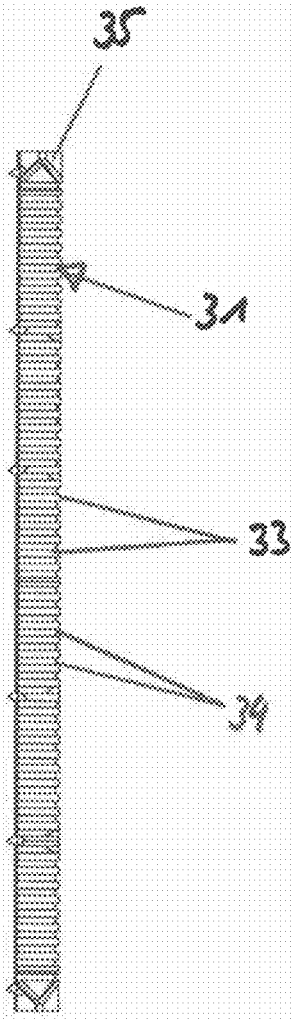
FIG. 9 is a frontal view of the packing of FIG. 8.

FIGS. 8 and 10 show a packing 20 in accordance with the invention which for the sake of clarity has only two film elements 21 arranged one behind the other in the thickness direction 40 in the example shown.

When used as intended, packing 20 is supplied with air from below with respect to the drawing plane according to FIG. 8, as the arrows 27 show. The air flows into the flow passages 25 and through the packing 20 and leaves the same at the top with respect to the drawing plane according to FIG. 8. In counter-flow to this, the packing 20 is supplied with water from above with respect to the drawing plane according to FIG. 8 and corresponding to the arrows 28. The water trickles through the packing 20 from top to bottom with respect to the drawing plane according to FIG. 8 and leaves the packing 20 via the lower end region 35 with respect to the drawing plane according to FIG. 8.

The flow passages 25 of the film elements 21 arranged one behind the other in thickness direction 40 complement each other to form film pair passages 39, as can be seen in particular from the sectional view according to FIG. 10.

Figure 11:
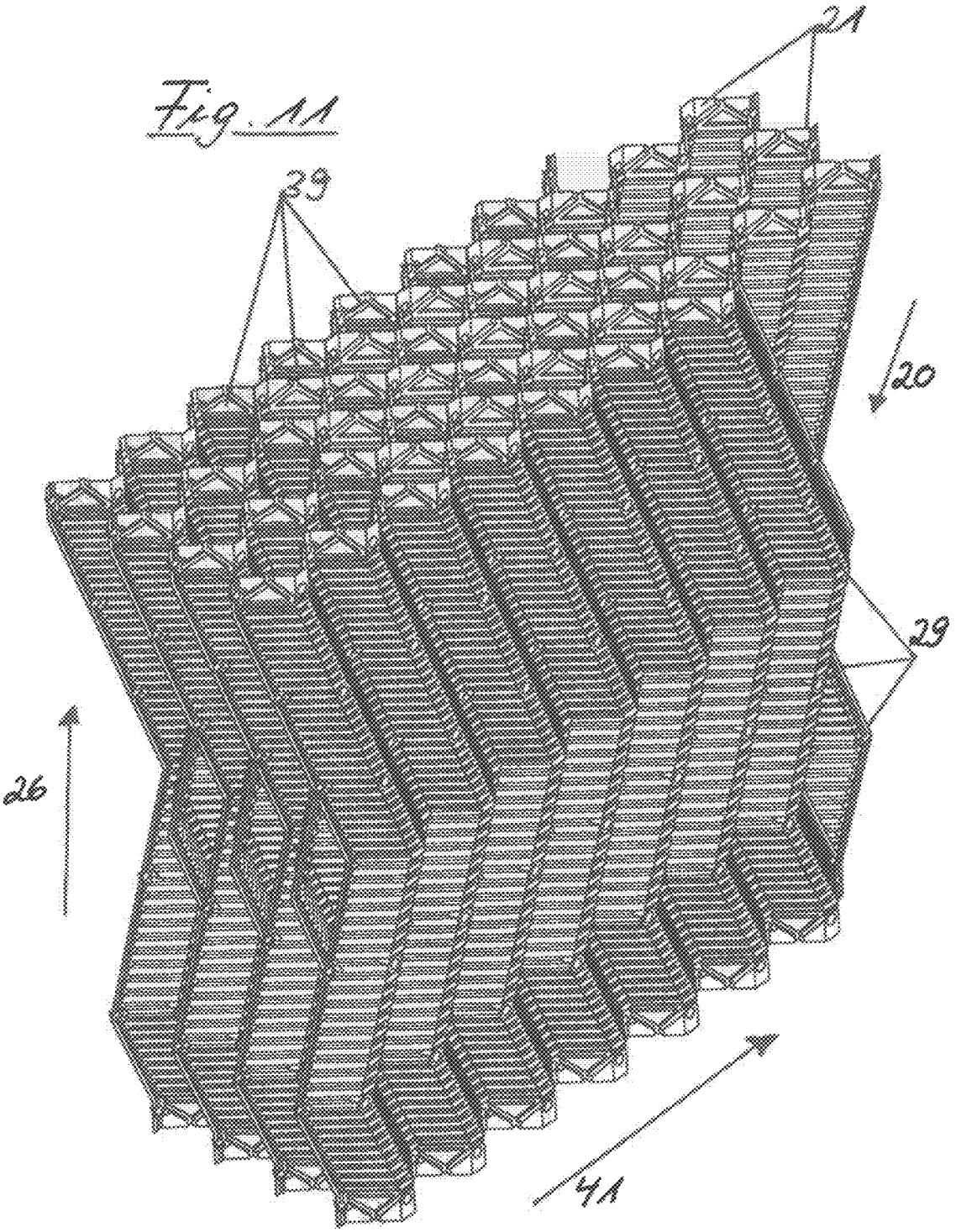
FIG. 11 is a schematic perspective view of the packing according to the invention shown in FIG. 8.

FIG. 11 clearly shows that the film elements 21 arranged one behind the other in the thickness direction 40 each provide zigzag flow passages 25, the flow passage 25 of adjacent film elements 21 extending with opposite inclination and crossing while forming the points of contact 29. The wave crests 23 and wave troughs 24 of a corrugation 22 of the contoured elements 21 are connected to each other in width direction 41, as can also be seen clearly from FIG. 11.

Figure 12:
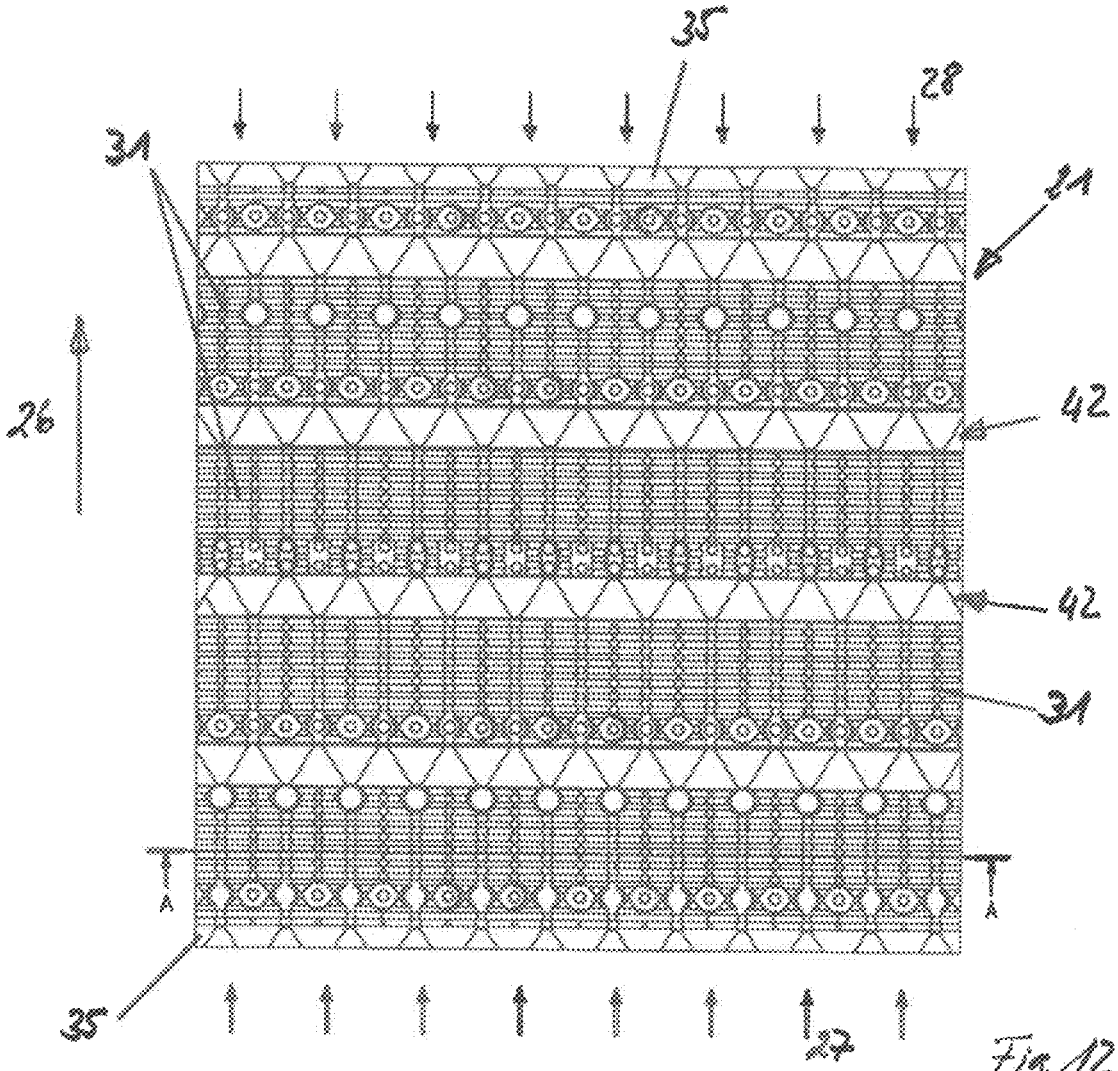
FIG. 12 is a schematic view of a film element of a packing according to a second embodiment of the invention.
Figure 13:
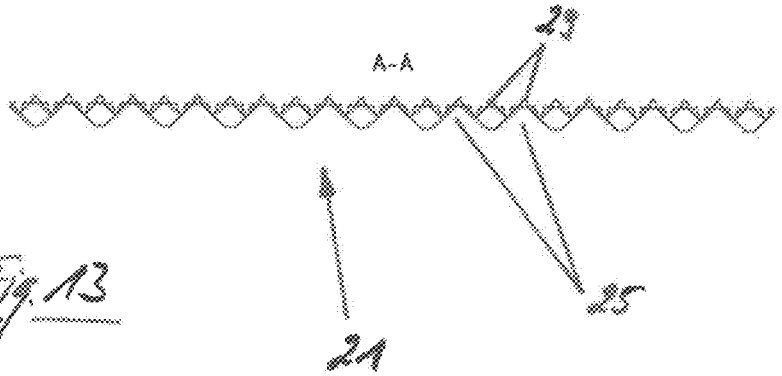
FIG. 13 is a schematic sectional view of the film element of FIG. 12 according to section line A-A.

In accordance with a second embodiment of the invention, shown in FIGS. 12 and 13, the film elements 21 are equipped with flow passages 25 running in a straight line in the longitudinal direction 26, the flow passages 25 being divided into sections which are offset from each other in the width direction 41. In contrast to the preferred embodiment according to the above FIGS. 2 to 11, no zigzag design of the flow passages 25 is provided.

In accordance with the preferred embodiment according to FIGS. 2 to 11, it is also provided that the fine contouring 31 of the film elements 21 extends over the entire surface of the large surfaces 30, with the exception of the end regions 35. The alternative embodiment according to FIGS. 12 and 13 shows a fine contouring 31 that is interrupted in longitudinal direction 26 of the film element 21 by areas 42 without fine contouring. Such a design can result in particular from manufacturing reasons.

The fine contouring according to the invention is in the form of a ribbing 32, as already described above in context with FIG. 5. The ribbing 32 comprises rib webs 33 and rib grooves 34 succeeding each other in the longitudinal direction 26, each of the rib webs 33 providing a rib web plateau 43. According to the invention it is provided that transitions between successive rib webs 33 and rib grooves 34 are substantially free of radii. With respect to the rib web plateau 43, i.e. with respect to the extension of the rib web plateau 43 in the longitudinal direction 26, it is preferred that the transition radii are formed <20%, preferably <10%, even more preferably <5% of the width of the rib web plateau of the corresponding rib web 33.

The combination of the flow passages 25 of two adjacent film elements 21 results in a film pair passage 39, as can be seen in the sectional view according to FIG. 10 in particular. A polygonal, preferably hexagonal design of the film pair passage 39 is preferred, as shown in FIG. 10.

For the design of the film pair passage 39, which is hexagonal in cross-section, a flow passage 25 defined by three strip elements 44, 45 and 46 is provided for each film element 21. The edge lengths, i.e. the widths of the strip elements 44, 45 and 46, differ from each other.

The strip elements 45 and 46 have the same width, i.e. the same edge length in relation to the cross-section, and exceed the width of the first strip portion 44 or its edge length in relation to the cross-section. The edge length S1 of the first strip element 44 and the edge lengths S2 of the second strip element 45 and the third strip element 46 are illustrated as an example in FIG. 10. The width or edge ratio S1/S2 is preferably between 0.3 and 0.4, most preferably 0.35.

What is claimed:

1. A packing for heat and/or mass transfer between liquid and gaseous media in counter-flow comprising a plurality of film elements contoured by corrugations, said corrugations providing flow passages and said film elements being successively arranged behind each other in the thickness direction forming points of contact, wherein adjacent film elements are connected to each other at their contact points and wherein mutually facing large surfaces of adjacent film elements have a fine contouring, wherein said fine contouring comprises a ribbing with rib webs and rib grooves running transversely to the flow passages, wherein a rib groove is arranged between two adjacent rib webs, wherein transitions between successive rib webs and rib grooves are designed in such a way that the transitions are substantially free of radii, wherein end regions of a film element which are opposite each other in the longitudinal direction are free of fine contouring, wherein channels are formed in the end regions of the film elements which are free of fine contouring and extend obliquely with respect to the longitudinal extension of the film elements, into which channels the flow passages open, wherein a film element has two channels for each flow passage, which channels are aligned to each other in a V-shape.

2. The packing according to claim 1, wherein the corrugations provide flow passages which are inclined in the longitudinal direction of the film elements, the film elements being arranged alternately in the thickness direction, so that the flow passages of adjacent film elements extend oppositely inclined and cross while forming the contact point.

3. The packing according to claim 1, wherein the transition radii are less than 20% of the rib web plateau width of the corresponding rib web.

4. The packing according to claim 1, wherein a rib groove has a groove depth of 2 mm to 3 mm.

5. The packing according to claim 1, wherein the two channels open into a common outlet that is aligned in the direction of the longitudinal extension of the film elements.

6. The packing according to claim 1, wherein the mutually facing flow passages of adjacent film elements form a film pair passage with a polygonal cross section on the input and output sides respectively.

7. The packing according to claim 1, wherein the corrugations of the film elements comprise a first strip portion extending in the longitudinal direction of said film elements as well as a second and a third strip portion disposed thereon along its respective longitudinal edges, said second and third strip portions being inclined to said first strip portion.

8. The packing according to claim 7, wherein the second and third strip portions are of equal width and each has a width that exceeds the width of the first strip portion.

9. The packing according to claim 8, wherein the width ratio of the first strip portion to the second strip portion or of the first strip portion to the third strip portion is between 0.3 and 0.4.

10. The packing according to claim 7, wherein the width of the first strip portion is at least 5 mm.

* * * * *